US005954117A

United States Patent [19]

Godinho

[11] Patent Number: 5,954,117

[45] Date of Patent: Sep. 21, 1999

[54] HIGH SPEED ROLL CASTING PROCESS AND PRODUCT

[75] Inventor: Wilton D. Godinho, Shanghai, China

[73] Assignee: Alcoa Aluminio Do Nordeste S.A., Itapissauma, Brazil

[21] Appl. No.: 08/981,623

[22] PCT Filed: Jun. 14, 1996

[86] PCT No.: PCT/US96/10319

§ 371 Date: Apr. 14, 1998

§ 102(e) Date: Apr. 14, 1998

[87] PCT Pub. No.: WO97/00147

PCT Pub. Date: Jan. 3, 1997

[30] Foreign Application Priority Data

Jun. 16, 1995 [BR] Brazil ..... 9502834

[51] Int. Cl.[6] ..... B22D 11/06; B22D 11/07; B21B 1/46

[52] U.S. Cl. ..... 164/472; 164/476; 164/480

[58] Field of Search ..... 164/472, 468, 164/480, 428, 476

[56] References Cited

U.S. PATENT DOCUMENTS

| | | | |
|---|---|---|---|
| 3,322,184 | 5/1967 | Cofer et al. . | |
| 3,557,866 | 1/1971 | Barrow et al. | 164/158 |
| 4,027,716 | 6/1977 | Theobald et al. | 164/19 |
| 4,487,157 | 12/1984 | Bergeron et al. | 118/59 |
| 4,487,790 | 12/1984 | Bergeron et al. | 427/422 |
| 4,588,021 | 5/1986 | Bergeron et al. | 164/432 |
| 4,749,027 | 6/1988 | Allyn et al. | 164/455 |
| 4,830,088 | 5/1989 | Miller | 164/472 |
| 4,842,042 | 6/1989 | Bartlett et al. | 164/463 |
| 4,915,158 | 4/1990 | Wood | 164/431 |
| 5,086,827 | 2/1992 | Graham et al. | 164/452 |
| 5,353,861 | 10/1994 | Roder et al. | 164/454 |

FOREIGN PATENT DOCUMENTS

| | | |
|---|---|---|
| 4233964 | 4/1993 | Germany . |
| 5861953 | 4/1983 | Japan . |
| 3243250 | 10/1991 | Japan . |

*Primary Examiner*—Kuang Y. Lin
*Attorney, Agent, or Firm*—Joseph H. Handelman; Gary P. Topolosky

[57] ABSTRACT

The present invention pertains to a method for casting metal between two casting surfaces (8, 10), such as a roll caster, by feeding molten metal (16) into the caster. A fine, uniform layer of carbonaceous material (32) is applied to the exterior of the casting surface (28) upstream of a casting zone (2). Thereafter, the molten metal is solidified as it passes through the casting zone (Z), and the gauge of the solidified metal is reduced at least 10%. The cast sleet (12) of this invention exhibits a uniform surface appearance.

18 Claims, 5 Drawing Sheets

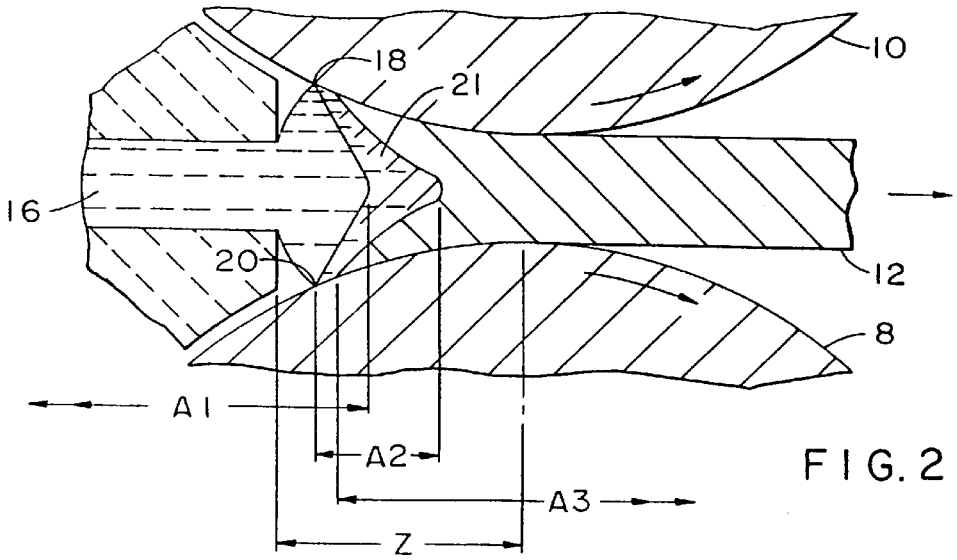
FIG. 2
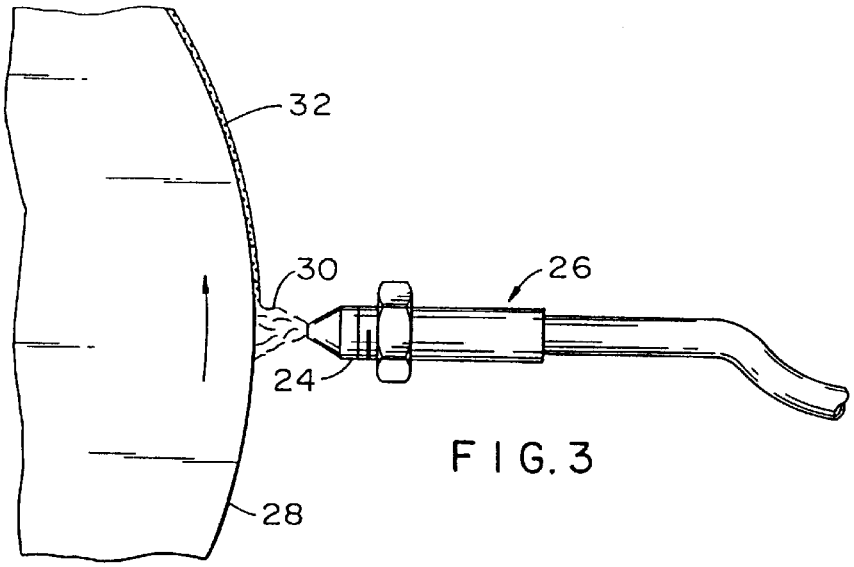
FIG. 3
FIG. 4
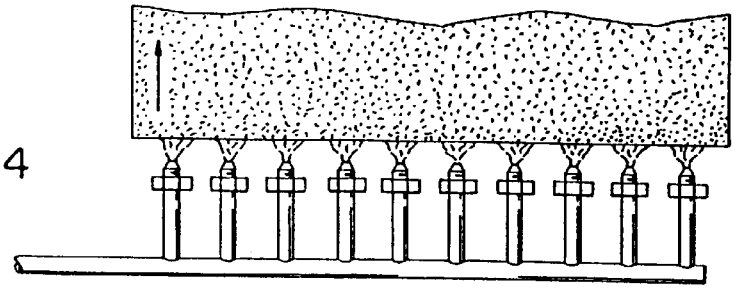

HIGH SPEED ROLL CASTING PROCESS AND PRODUCT

BACKGROUND OF THE INVENTION

The present invention relates to a method of producing metal sheet by a casting process. More particularly, this invention pertains to a process for producing roll cast aluminum sheet products on a twin roll caster at higher than conventional casting speeds.

DESCRIPTION OF THE ART/TECHNOLOGY REVIEW

Metal sheet, plate and foil products have been made by a variety of processes. One process for producing aluminum and aluminum alloy sheet is the roll casting process. The present invention is particularly directed to the process of roll casting using twin casting rolls. In this preferred process, molten metal, which is typically filtered and may be alloyed and refined, is fed between mating casting rolls. Such rolls may be of various widths and diameters, with 600 to 1,000 mm roll diameters being common, as are strip product widths on the order of 1 to 2 meter. The rolls are cooled, such as by internal liquid cooling, to cause the exterior surface of the roll shell to be maintained at a temperature sufficient to cause progressive solidification of the molten metal as the metal passes through the bite of the rolls, undergoes reduction and forward extrusion due to high applied load, and exits at a gauge of typically 2 to 8 mm. The metal sheet exiting the caster is coiled for subsequent hot rolling, cold rolling, homogenization and annealing.

In roll casting there are a number of factors that affect productivity and product quality. These factors include, but are not limited to, metal preparation, metal transfer, gauge control, solidification behavior such as centerline segregation, constituent distribution, and thermal management, surface uniformity, flatness and appearance and sheet-to-roll adherence (sticking) during casting.

Solidification is, of course, a limiting factor in attaining increased productivity in casting, particularly in roll casting. The casting speed must be controlled at a rate that insures that the outside walls of the sheet are adequately and progressively solidified. Also, casting speed must insure that the entire sheet is solidified prior to hot reduction of the sheet. Solidification must be uniform to insure that internal voids are not present. A surface void condition, called a bleed-out, must be avoided. As casting speed is increased, it has been found that the casting roll surface temperature increases. Likewise, the temperature of the outside surface of the cast product increases. As the temperatures of the aluminum sheet being cast and the outside shell of the steel casting roll rise, the surfaces experience a surface welding which tends to cause sticking of the sheet to the roll. When such sticking occurs, the casting speed must be reduced.

One approach to alleviating the sticking condition is to provide an agent on the roll surface. Such agents include release agents which act to prevent sticking between the sheet and the outside shell of the casting roll. Typical agents that have been used in roll casting are graphite and magnesium oxide.

However, the application of a thermal barrier may impede the cooling efficiency in the casting process since the thermal barrier serves as an insulative layer between the sheet and roll shell. So, when using a release agent with the intent of being able to maintain the casting speed to avoid a sticking situation, the thermal efficiency is reduced thereby requiring a reduction in the casting speed to avoid a melt-through or a bleed-through condition.

It has also been found to be difficult to apply a uniform coating of a release agent onto the surface of a roll shell. Areas not covered by the release agent tend to cause microwelding to occur between the cast strip and the roll shell.

The prior art discloses various casting surface treatments for various purposes. For example, Hazelett Strip Casting Corporation discloses in a number of U.S. patents, including U.S. Pat. No. 4,487,157, U.S. Pat. No. 4,487,790, U.S. Pat. No. 4,588,021, U.S. Pat. No. 4,749,027, U.S. Pat. No. 4,915,158, and U.S. Pat. No. 5,086,827, the importance of providing a permanent, insulative coating on the casting surface of belts used in a horizontal belt caster. Such permanent surface coatings are fusion bonded permanent matrix coatings covered with a dry, porous belt dressing. In operation, a gaseous layer, such as helium, may also be provided. An example of dry belt dressings for thermal insulative purposes are graphite, acetylene soot or other carbonaceous materials. A coat of binder or diatomaceous silica may also be continuously or intermittently provided to coated belts of these horizontal belt casters. U.S. Pat. No. 3,322,184 also discloses the application of a thermal barrier, such as soot, to a groove in a copper casting wheel to retard the transfer of heat from the cast product to the casting wheel, and protect the copper casting surface during a bar casting process.

Other casting processes have disclosed the use of thermal barriers. For example, Battelle. Development Corporation in U.S. Pat. No. 4,842,042 teaches the use of a roll skimmer to control gauge in a melt drag type of process, and suggests that a parting agent such as carbonaceous graphite powder or soot, could be used on the roll skimmer to prevent sticking of the metal to the skimmer. U.S. Pat. No. 4,027,716 discusses coatings and surface treatments for applying a thermal insulating layer onto a continuous casting belt. Exemplary materials are dispersions of refractory materials to which carbon or graphite are added.

Apparatus and equipment for obtaining a required thermal barrier agent have also been disclosed in the prior art for bar casters to avoid distortion or wear in a casting surface. U.S. Pat. No. 3,557,866 shows an apparatus for applying a liquid thermal barrier and release agent to the bottom and the sidewalls of a peripheral groove in a casting surface into which bars are cast. Also, U.S. Pat. No. 4,830,088 discloses an apparatus for applying an insulative layer of carbon to individual faces of a groove in a rotating mold surface to act as a lubricant to be able to remove a bar from a grooved copper mold, and to serve as a heat insulator between the copper casting surface and the metal being cast.

Despite the efforts made in the area of applying surface agents to various casting surfaces, there is still a need for an aluminum twin roll casting process which involves a unique casting situation, as compared to alternative casting processes, that permits higher than conventional roll casting speeds to be achieved.

SUMMARY OF THE INVENTION

The present invention may be summarized as providing a method for high speed casting of metal sheet. The casting method involves moving two opposed casting surfaces, such as axially aligned twin rolls relative to one another. The casting surfaces are maintained at an exterior surface temperature adequate to progressively solidify molten metal fed between the casting surfaces. A uniform layer of a very fine carbonaceous material is applied to the casting surfaces at a layer thickness of less than about 1.5 micron, and preferably less than about 0.4 micron. Molten metal is progressively solidified as the metal passes through the casting zone of the caster. Such solidification is completed prior to reducing the gauge of the solidified product at least 10% by compressing the solidified product between the casting surfaces.

In a preferred embodiment, this invention relates to the uniform application of a fine carbonaceous material to the exterior surfaces of the rolls of a roll caster, and then feeding a molten aluminum alloy into the roll bite. The aluminum strip is solidified and rolled in the roll bite at a rolling force adequate to accomplish a gauge reduction of at least 10%. A high rolling force may negate the insulative effect of the thin, uniform carbonaceous layer while retaining the parting agent benefits and thereby permits higher than conventional casting speeds to be attained.

An objective of this invention is to provide an improved roll casting process in which a fine carbonaceous material is applied to the exterior surface of the rolls in a uniform, thin coating that retains the advantages of a release agent to prevent sticking between the roll surface and the surface of the cast product, while avoiding the disadvantages of a thermal barrier.

Another advantage of this invention is to provide a roll casting process that permits a significant increase in the speed of the roll caster.

An advantage of this invention is that the compressive condition peculiar to roll casting in which the cast product is hot rolled to affect a reduction of at least 10% after solidification, as the sheet passes through the centerline of the rolls, may prevent a thin, uniform layer of carbonaceous material from adversely acting as a thermal barrier while retaining the properties of a release agent to prevent sticking.

Another advantage of this invention is that water, or other liquid agents are not required to deliver the carbonaceous material to the casting surface. This may improve roll shell life since the roll shell may not thermally fatigue as fast.

A further advantage of this invention is that sheet may be cast at relatively high casting speeds which exhibits a more uniform surface texture and appearance.

These and other objectives and advantages of this invention will be more fully understood and appreciated with reference to the detailed description and the accompanying drawings.

BRIEF DESCRIPTION OF THE DRAWINGS

FIG. 2 is an enlarged cross-sectional view taken about the centerline of a pair of axially aligned twin casting rolls illustrating the thickness and condition of the metal as it progressively solidifies and is reduced as the metal passes through the roll bite.

FIG. 3 is a view of an exemplary apparatus which can be used to deposit a carbonaceous layer of material onto the exterior surface of a rotating casting roll.

FIGS. 4, 5, 6 and 7 illustrate alternative apparatus that could be used to deposit a uniform, thin layer of a carbonaceous material on the exterior surface of a rotating casting roll.

DETAILED DESCRIPTION OF THE INVENTION

Figure 1:
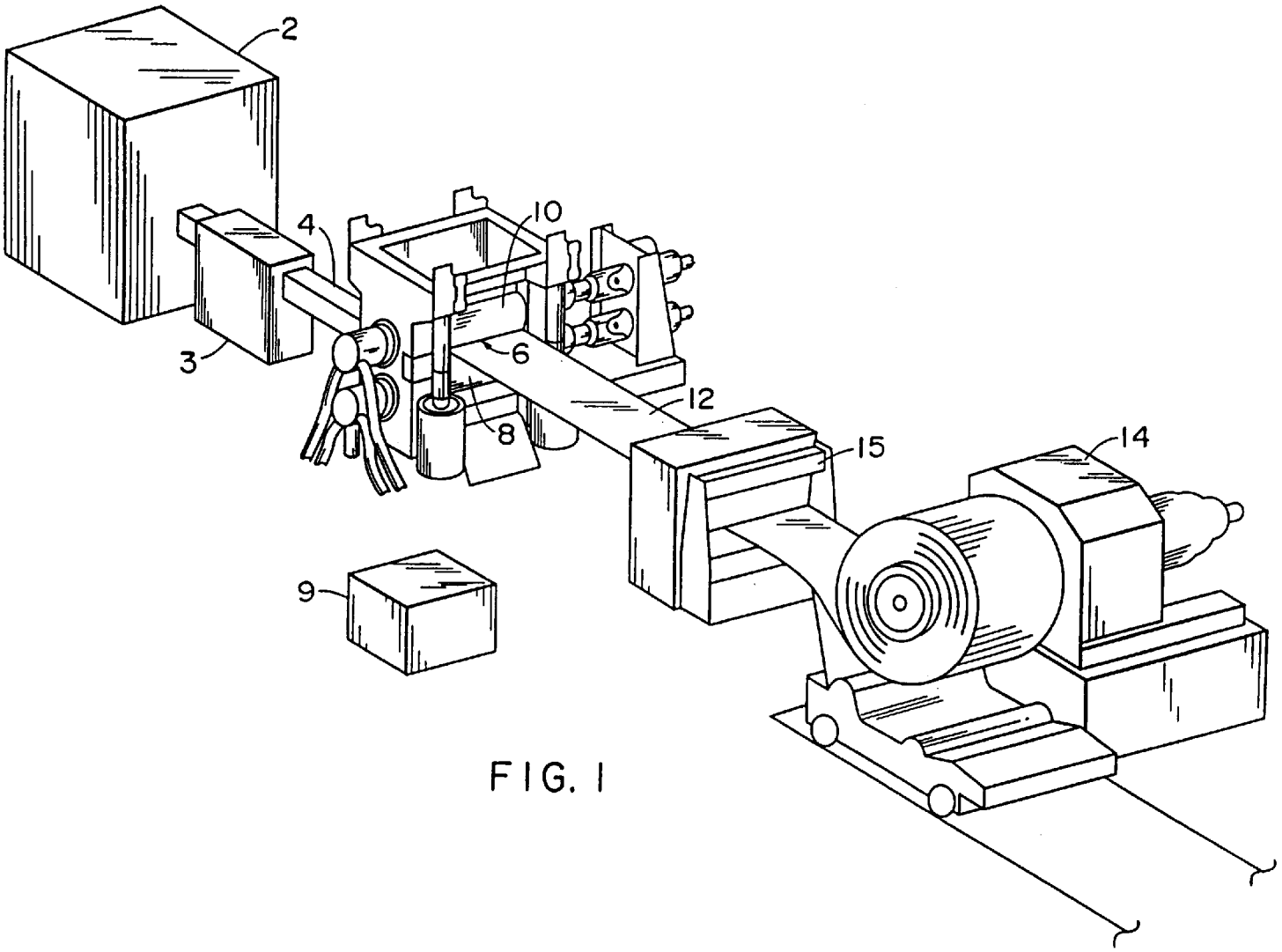
FIG. 1 is a sketch of a typical arrangement for a horizontal roll casting operation from a melting furnace through a roll caster to a coiler for finished product.

FIG. 1 illustrates a typical arrangement for a horizontal roll caster. As shown in FIG. 1 metal is melted in a furnace 2. The molten metal may be alloyed, cleaned and filtered through typical melt treatment equipment 3. The molten metal is then transferred and is fed typically along a trough 4, which is covered and is sometimes heated to retain temperature, to a roll bite 6 defined between the twin rolls 8 and 10 which are rotated relative to one another as shown by the arrows on the rolls in FIG. 2. The metal is progressively solidified in the roll bite and exits the caster as cast strip material 12 which is typically coiled on a coiler 14 as finished product for ease in handling. A strip guide and shear unit 15, as shown, may be used to guide the strip and cut product when coils are to be changed. A controller 9 monitors and controls the various roll casting parameters.

It will be understood by those skilled in the art that although the present invention is described with specific reference to the horizontal roll casting process, the invention may be applicable to vertical roll casting and other casting processes where progressive solidification followed by a gauge reduction of the hot, solidified material may occur.

FIG. 2 illustrates the casting zone Z of a roll caster. As shown, the molten metal 16 is fed to the roll bite. It is important that the molten metal temperature be substantially uniform across the width of the nozzle feeding molten metal into the roll bite. It is equally important to minimize turbulence during the feeding of the molten metal so that steady state conditions can be attained and maintained. As shown in the drawing, the molten metal begins to solidify at the initial point of contact 18 with the upper roll 10 and simultaneously at the initial point of contact 20 with the lower roll 8. Solidification of molten metal continues progressively from the opposed outside surfaces of the sheet being cast toward the center of the product.

The casting zone Z shown in FIG. 2 is typically less than about 100 mm in total length. Casting zones of 50 to 80 mm are common depending on casting roll diameter, which determines the "set back", the alloy being cast, roll temperatures, product gauge and the like. The casting zone Z is characterized by three distinct areas. The first area A1 is where solidification begins but the majority of the metal is in the molten state. Thermal efficiency in this area is high. The second area A2 is where the internal molten metal has not yet solidified but is not in the molten state. This area is commonly known as the mushy zone 21. Thermal conductivity in this mushy zone is typically poor, because the metal begins to solidify and contracts away from its contact with the roll surface. Additionally, the prior practice of using water or other agents to carry a surface agent, such as graphite, to the roll results in some liquid being present in this zone. The evaporation of the liquid may create a gaseous barrier between the metal and the roll further insulating them and decreasing the thermal efficiency of the cooling process. The third area A3 begins where the metal is solidified and ends at the centerline of the rolls. Thermal efficiency in this third area is also high.

During progressive solidification of the metal through these three zones a number of phenomena occur. In the mushy zone A2, as metal solidification progresses, the metal tends to contract. A minute gap actually is created between the solidified metal and the cooled roll surface. This gap causes the thermal cooling efficiency to be reduced dramatically. Then, as the metal progresses to the solidus zone A3, the metal is compressed between the rolls. Such compression creates a significant separating force in the roll bite, and brings the metal into intimate contact with the cooled roll surface. Hot rolling occurs at the centerline to reduce the gauge of the solidified metal sheet by at least 10%, and typically from 10 to 20% reduction. Reductions of gauge on the order of 50% may be possible in roll casters.

As explained above, roll caster productivity is an important issue. It has been found that as roll casting speeds are increased the temperatures of both the exterior surface of the roll and the cast product increase. This increase in temperature, coupled with the relatively high separating forces, on the order of about 0.75 to about 1.25 ton per square meter, causes the surfaces of the roll and the cast product to weld together. At higher speeds, the solidification front moves farther into the roll bite so hotter metal experiences higher forces. This condition is called sticking. The formation of aluminum-iron intermetallics have been observed at the interface has been observed at the interface, indicating that a chemical reaction has occurred.

To avoid sticking the casting speed can be reduced, but this defeats the productivity objective. An alternative is to apply a surface agent that will counteract the sticking. Common agents to accomplish this are graphite and magnesium oxide. However, such coatings have been applied in a fashion that the coatings act as a barrier to the chemical reaction between aluminum and iron. Also, such coatings may be an insulative coating between the cooled roll surface and the surface of the product being cast. The resultant effects reduce the cooling efficiency of the roll caster and limit the casting speed. So, in the past, roll caster operators tried to strike a delicate balance between avoiding sticking and maximizing the thermal efficiency to maximize productivity.

Figure 10:
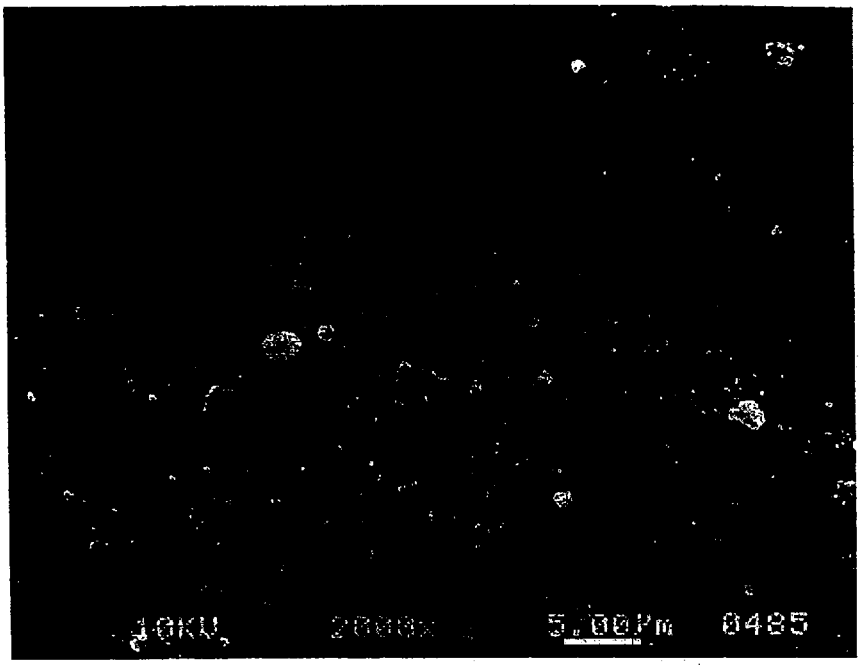
FIG. 10 is a photomicrograph of a layer of colloidal graphite, of the prior art, applied onto a surface, shown at 2000 magnification (2000×).
Figure 11:
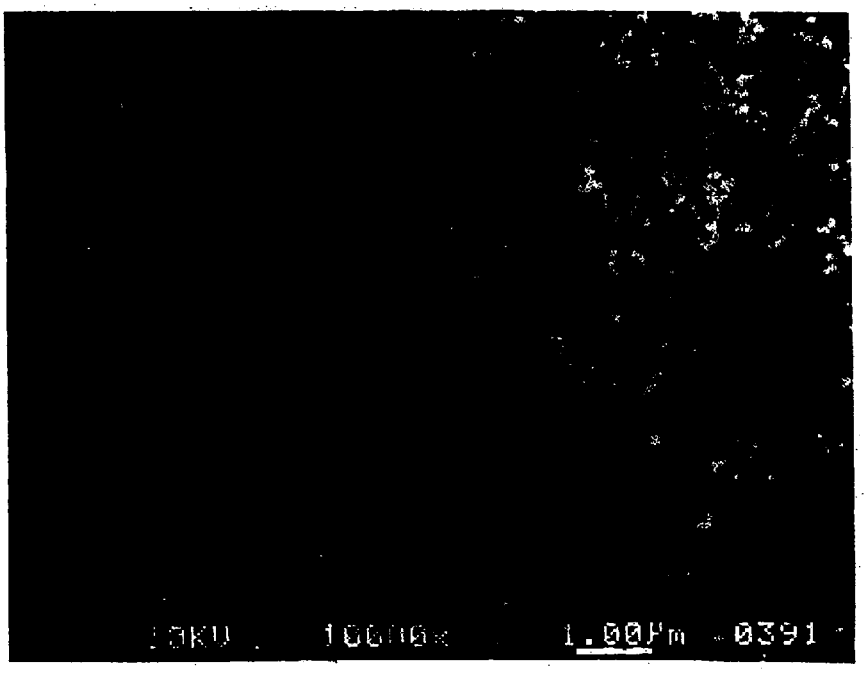
FIG. 11 is a photomicrograph of the fine soot layer of FIG. 8 shown at 10,000 magnification (10,000×).

The present invention eliminates the need to identify a balance between these features. In the present invention, a very fine carbonaceous layer is applied uniformly to the surface of the roll caster. In a preferred embodiment a very thin layer of very fine soot is applied to the outside surface of the casting rolls at a location upstream of the roll bite. Soot particles of the present invention are typically of a size less than about 0.1 micron. FIG. 10 illustrates soot particles at 10,000 magnification showing such particle size. Soot can be applied in a very thin layer, typically less than 1.5 micron in thickness, by burning acetylene gas and directing the flame against the roll surface. A single pass of an acetylene torch across a roll surface has been found to deposit a layer of soot that is about 0.4 micron thick. Four passes of the acetylene torch is found to deposit a layer of soot that is about 1.5 micron thick. Such thickness may, of course, vary depending on torch parameters, e.g., flow, distance from roll surface, etc.

Figure 8:
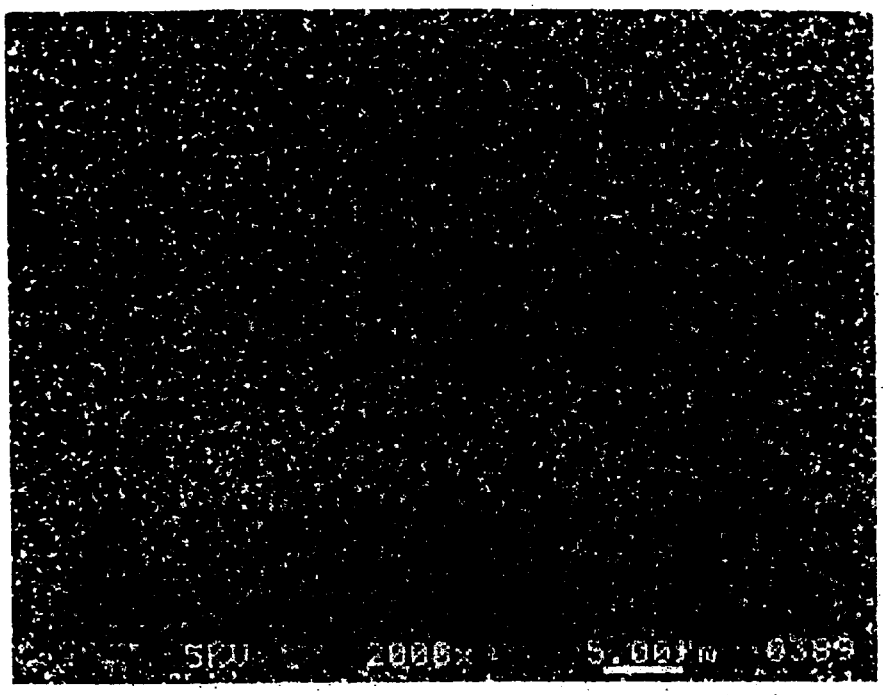
FIG. 8 is a photomicrograph of a layer of fine soot applied onto a surface by passing an acetylene torch along the surface one time, shown at 2000 magnification (2000×).
Figure 9:
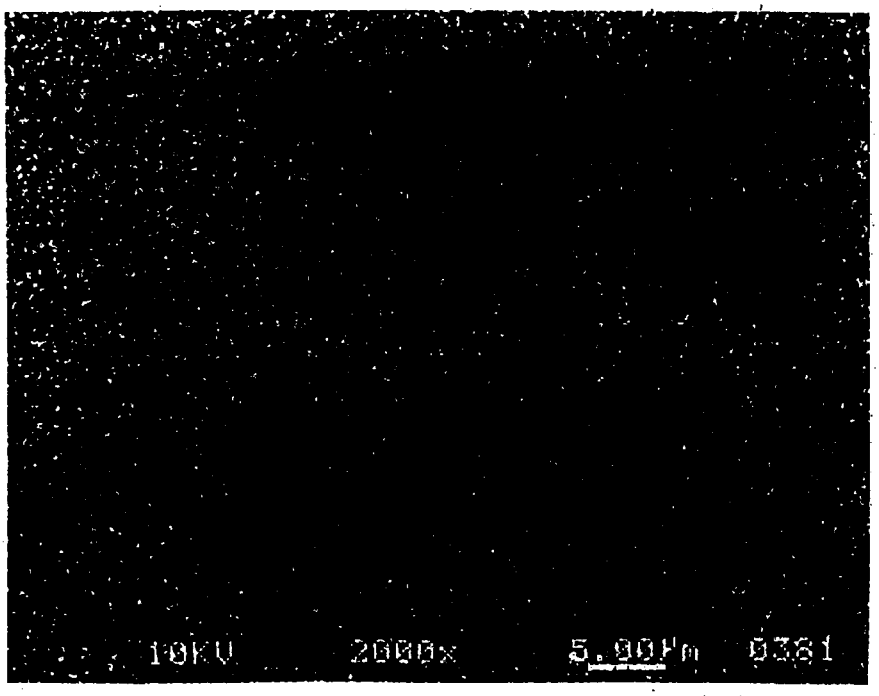
FIG. 9 is another photomicrograph of a layer of fine soot applied onto a surface with four passes of an acetylene torch along the surface, shown at 2000 magnification (2000×).

In the present invention the fine carbonaceous material covers substantially the entire surface of the roll. Note in FIGS. 8 and 9 that virtually the entire surface is covered with the soot, even when the soot layer is thinner than about 0.4 micron (4220 Angstroms) in FIG. 8, or about 1.3 micron (13,580 Angstroms), in FIG. 9.

Also, the thickness of the soot layer is uniform. The thickness of the soot layer is substantially the same thickness across the roll onto which metal is to be cast. Such uniformity can be observed in FIGS. 8 and 9 which show the soot layer at 2000 magnification to be extremely uniform. For comparison purposes, FIG. 10 shows that colloidal graphite of the prior art does not have a fine particle size, is not applied in a thin layer, does not substantially cover the entire surface, and is not uniformly applied across the surface. FIG. 10 shows bare spots where molten aluminum would come into direct contact with the bare steel of the roll surface, forming an aluminum-iron intermetallic weld, or sticking condition. With the soot coating of the present invention, there is virtually no opportunity for such sticking to occur.

It will be appreciated that propane and natural gas may also be burned in the vicinity of the roll to provide the uniform, thin layer of soot. Alternatively, soot may be generated as a fine powder and the powder can be applied to the roll surface such as by spray or atomizer.

As shown in FIG. 3 the tip 24 of an acetylene torch 26 may be directed toward the roll surface 28 rotating in the direction illustrated by the arrow. It has been found beneficial to have the acetylene flame 30 impinge slightly against the surface where the soot is being deposited. It is also important that the flame not be concentrated at the same location for a time that causes too much soot to be deposited. The soot layer 32 must be sufficiently thin, such as less than about 1.5 micron, to avoid thermal insulation, and in addition the soot layer must be uniformly applied at the same thickness across the roll casting surface. For these reasons it is important to move the soot applicator or applicators relative to the casting surface in a substantially uniform fashion.

FIG. 4 shows an alternative embodiment in which a number of acetylene torches may be mounted laterally across the width of a casting roll. Care must be taken to assure that the carbonaceous material is deposited substantially across the entire surface of the moving drum. Therefore, spacing of the torches is important. As an alternative, the mounted torches shown on FIG. 4 could be oscillated or rotated to insure substantially complete and uniform coverage on the roll surface.

Figure 5:
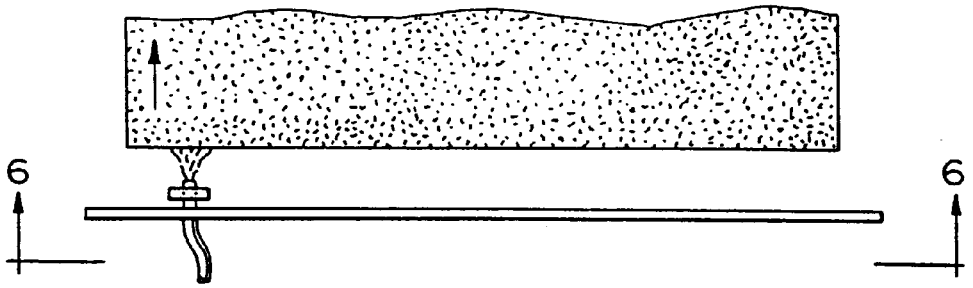
Figure 6:
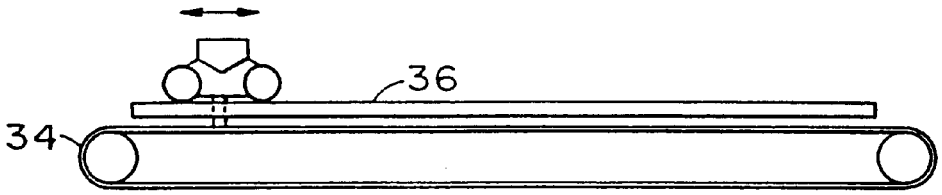

FIGS. 5 and 6 illustrate an alternative embodiment in which a single acetylene torch is driven across the face of the rotating drum to provide a uniform, thin coating of material on the casting roll surface. Although FIG. 6 shows a drive sprocket and chain mechanism 34 that moves the torch along a track 36, any mechanical, electrical or pneumatic device, or combination of devices, could be employed to move the torch or a plurality of torches. It has been found that moving a torch at a rate of about 10–40 meters per minute across a casting roll surface which is rotating at a rate of about 1.5 to 2.5 meters per minute is adequate to provide a thin uniform layer of soot on the casting roll. At higher casting speeds it may be necessary to increase the speed of the moving torch or add torches to assure adequate and uniform coverage onto the roll surface.

Figure 7:
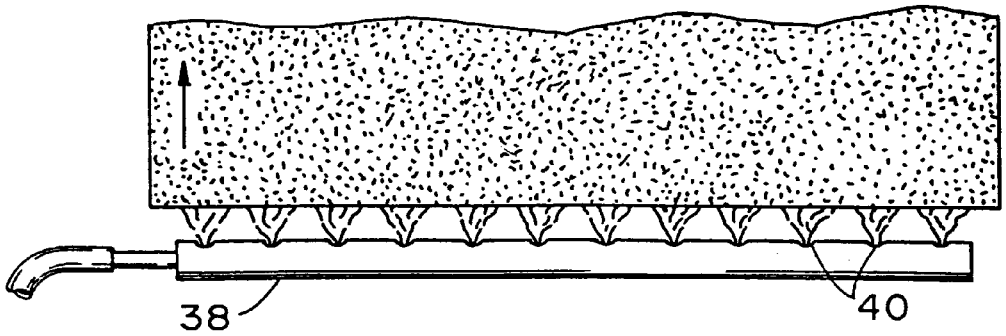

FIG. 7 shows another alternative embodiment for burning a gas to deposit a carbonaceous material in the vicinity of a rotating drum to deposit the thin, uniform layer of carbonaceous material. In this embodiment, a burner tube 38 with multiple perforations 40 is provided. The perforations should be sized, located and positioned for optimum results. The burner could be stationary or it could oscillate alone or in combination with other burners to accomplish the carbonaceous layering or deposition of this invention.

EXAMPLES

To illustrate the present invention the following comparison is made. A roll caster was operated to cast alloy 1145 to an as-cast gauge of about 5 mm, with a thick, nonuniform colloidal graphite layer, and then the same alloy was cast to the same gauge using a thin, uniform layer of soot. The following operating parameters and measurements were obtained:

| Operating Parameter | Graphite | Soot |
|---|---|---|
| Alloy | 1145 | 1145 |
| Exit Gauge | 5 mm | 5 mm |
| Metal Flow Rate | 59 lb/in/hr of width | 100 lb/in/hr of width |
| Sheet Width | 1450 mm | 1450 mm |
| Temperatures: | | |
| molten metal in furnace | 800° C. | 780° C. |
| molten metal at the filter | 770° C. | 750° C. |
| molten metal at the nozzle (tip) | 695° C. | 685° C. |
| roll sheet - at beginning of casting zone | 100° C. | 120° C. |
| roll sheet - at the exit of casting zone | 500° C. | 500° C. |
| Carbonaceous Layer: | | |
| type of material | colloidal graphite | soot |
| thickness | varies 0–2 micron | 0.4 micron |
| uniformity | non-uniform | very uniform |
| particle size | varies up to about 4 micron | uniform of about 0.1 micron |
| structure | crystalline | amorphous |
| Method of Application | graphite/water spray | acetylene burn |
| Separating Force | 350 ton | 280 ton |
| Casting Speed | 1.3 meter/minute | 2.2 meter/minute |
| Rolls | | |
| diameter | 630 mm | 630 mm |
| exterior roll shell material | steel (CMYV grade) | steel (CMYV grade) |
| Product Quality | good surface | better - more uniform surface |

The surface of the metal strip roll cast in accordance with the present invention exhibits a more uniform appearance as compared to metal strip cast using colloidal graphite. Such improvement in uniform appearance is attributed directly to the uniform application of the fine soot onto the roll casting surface. Such uniform application eliminates small areas of welding which have been observed with graphite coatings due to the, coating nonuniformity of graphite. It is expected that the improvement in uniformity of the as-cast surface will also produce an improved surface finish in the final rolled product.

It has also been found that the roll shell life may be extended by as much as 56% by the present invention. This may be due to the decrease or elimination of the intermetallic weld, or sticking, that previously led to surface cracking on the roll shell. Also, increased roll shell life may be due to the fact that the roll shell surface is not being cooled by an agent, such as water, used to carry other surface agents to the roll shell surface such as through a spray, so less temperature variation is experienced on the roll shell surface.

By providing a thin, uniform layer of soot on the outside surface of the casting rolls of a roll caster, the insulative effects of the soot are negligible. It is found that soot may be applied at various densities.

The soot of the present invention, which is applied with the application of an acetylene torch, is found through a thermal gravometric analysis (TGA) to contain substantially no unburned hydrocarbons. Therefore, there is substantially no hydrocarbon residue in the carbonaceous layer of soot in a preferred embodiment of this invention.

The present invention permits roll casting speed to be increased. The insulative effects of the thin, uniform layer of carbonaceous soot, if any, are negligible. Speed increases in excess of 25%, and as high as 60%, have been obtained by this invention. Therefore, the present invention will be particularly valuable as roll casting technology progresses to higher than conventional speed.

As discussed above, the roll caster of this invention hot rolls the solidified strip as the strip passes through the roll bite. Such hot reduction is at least 10%, and possibly 50%. The heat encountered in such a hot rolling operation has the effect of substantially complete combustion of the carbonaceous material from the roll surface. Substantially complete burning assures that the carbonaceous material does not leave an unsightly, dirty residue on the strip surface. Most users of the strip material prefer, primarily for cosmetic reasons, that the strip material be substantially free of such residue.

What is believed to be the best mode of this invention has been described above. It will be apparent to those skilled in the art that numerous variations of the illustrated details may be made without departing from this invention.

What is claimed is:

1. In a method for casting metal sheet comprising:

rotating a pair of axially aligned rolls of a roll caster with respect to one another, the rolls being internally cooled such that an exterior surface of the rolls is maintained at a temperature sufficient to cause progressive solidification of molten metal being fed to a roll bite between the rolls, wherein the improvement comprises:

applying a uniform coating of a fine carbonaceous material at a uniform thickness of less than about 1.5 micron on and across the exterior surface of the rolls where metal is to be cast at a location upstream of the roll bite, feeding molten metal into the roll bite, progressively solidifying the molten metal as it is fed into and through the roll bite and completing solidification of the metal before the metal passes the centerline of the rolls, and hot rolling the solid metal as it passes through the centerline of the rolls at a separating force adequate to reduce the gauge of the solid metal by at least 10%.

2. A method as set forth in claim 1 wherein the metal is aluminum or aluminum alloy.

3. A method as set forth in claim 1 wherein the exterior surface of the roll is steel.

4. A method as set forth in claim 1 wherein the casting rolls are internally water cooled.

5. A method as set forth in claim 4 wherein the exterior surface temperature of the casting rolls at the entrance of the casting zone is about 60 to 250° C.

6. A method as set forth in claim 4 wherein the exterior surface temperature of the casting roll at the exit of the casting zone is about 400 to 600° C.

7. A method as set forth in claim 1 wherein the carbonaceous material is soot.

8. A method as set forth in claim 7 wherein the soot has a particle size of less than about 0.1 micron.

9. A method as set forth in claim 7 wherein the soot particles are amorphous.

10. A method as set forth in claim 7 wherein the soot covers the entire surface of the casting roll upon which metal is to be cast.

11. A method as set forth in claim 7 wherein the soot is applied at a uniform thickness of less than about 0.5 micron.

12. A method as set forth in claim 7 wherein the soot is applied by directing a flame against the exterior surface of the roll by burning a carbonaceous gas selected from the group consisting of acetylene, natural gas and propane.

13. A method as set forth in claim 7 wherein the soot is applied in fine particles of less than about 0.1 micron in diameter, to a uniform thickness of less than about 0.5 micron.

14. A method as set forth in claim 1 wherein the rolling force is adequate to reduce the gauge of the solidified metal by 30% to 80%.

15. A method as set forth in claim 7 wherein the soot contains substantially no hydrocarbon residue.

16. A method as set forth in claim 1 wherein the carbonaceous layer is substantially completely combusted at the temperatures and forces experienced in the roll bite of the roll caster such that substantially no carbonaceous residue is present on the surface of the cast product.

17. A method for twin roll casting aluminum alloy sheet material comprising:

rotating axially aligned twin rolls of a roll caster relative to one another, the rolls having an outside diameter greater than about 400 mm, and internally water cooling the rolls such that the exterior surface of the rolls is maintained at a temperature at the exit of a casting zone of from about 120° C. to about 200 ° C., wherein the improvement comprises:

applying a uniform layer of soot onto the exterior surface of the twin rolls at a location upstream of the roll bite by burning acetylene against the moving roll surface sufficiently to cover substantially all of the surface of the roll against which aluminum sheet is to be cast at a thickness not to exceed about 0.5 micron, continuously feeding molten aluminum alloy into the roll bite between the soot coated twin rolls, and progressively solidifying the molten aluminum as it passes through a casting zone from the molten state, through a mushy zone to the solid state upstream of the centerline of the rolls, and reducing the gauge of the solid aluminum material at the centerline of the rolls from about 10% to about 80% at a rolling force and temperature that eliminates the insulative effect of the soot layer and substantially completely combusts the soot such that no soot residue is present on the cast product.

18. A method as set forth in claim 17 wherein the casting zone has a length of less than about 100 mm from the location where molten metal first contacts the casting surface to the centerline of the rolls.

* * * * *